United States Patent [19]

Gorondy

[11] 4,421,518

[45] * Dec. 20, 1983

[54] PRINTING PROCESS

[75] Inventor: Emery J. Gorondy, Chadds Ford, Pa.

[73] Assignee: E. I. Du Pont de Nemours & Co., Wilmington, Del.

[ * ] Notice: The portion of the term of this patent subsequent to Dec. 20, 2000 has been disclaimed.

[21] Appl. No.: 392,785

[22] Filed: Jun. 28, 1982

[51] Int. Cl.[3] ..... D06P 5/20

[52] U.S. Cl. ..... 8/471; 8/512; 8/922

[58] Field of Search ..... 8/471

[56] References Cited

U.S. PATENT DOCUMENTS

| | | | |
|---|---|---|---|
| 3,860,388 | 1/1975 | Haigh | 8/471 |
| 3,915,628 | 10/1975 | Bossard et al. | 8/471 |
| 4,099,186 | 7/1978 | Edwards et al. | 346/74.1 |
| 4,117,498 | 9/1978 | Edwards et al. | 346/74.1 |
| 4,124,384 | 11/1978 | Centa | 96/14 |
| 4,145,300 | 3/1979 | Hendriks | 252/62.1 |
| 4,246,331 | 1/1981 | Mehl et al. | 430/107 |

*Primary Examiner*—A. Lionel Clingman

[57] ABSTRACT

A process is described for dyeing a disperse dyeable material such as a textile or film comprising the steps of forming an image comprising a dye component which is substantially sublimable at from about 160° to 215° C., on a film of a thermally stable resin which is permeable to said dye component covering the dye image with a paper web or a resinous material and bringing the film into contact with a disperse dyeable material to be dyed while the film and disperse dyeable material are rotated upon a heated drum, with the disperse dyeable material facing the surface of the film opposite the said supporting the image, to thereby transfer said dye component from the film to the textile material.

9 Claims, 2 Drawing Figures

PRINTING PROCESS

BACKGROUND OF THE INVENTION

1. Field of the Invention

This invention relates to a process for printing a dye onto a textile fabric. More particularly, the process relates to forming a dye image of a sublimable dye on a film of polymeric material through which the dye can sublime and then transferring the dye to a textile fabric by sublimation thereof.

2. Description of the Prior Art

In the conventional printing of textiles, normally the fabric is adhered to a printing blanket that transports it under the printing rolls or screens. After all colors have been applied, the fabric goes through oven drying, then the dyes are fixed, e.g., by hot air or high pressure and high temperature steam. The textiles are then scoured and dried. In structurally unstable fabrics, such as double knits, waste, due to inadequate registration of the different colors, in some cases may amount to 20 to 30% of the printed textile.

Magnetic printing processes, particularly useful in overcoming the problem in electrostatic copying processes of unsatisfactory copying of large dark areas, are known in the art. Such processes are described, for instance, in the U.S. Pat. Nos. 4,099,186 and 4,117,498. The particular processes described in U.S. Pat. Nos. 4,099,186 and 4,117,498 relate to processes wherein a dye and/or other chemical treating agent contained in a ferromagnetic toner is transferred directly to a substrate e.g., such as a textile material, or is transferred to a first substrate such as paper for subsequent transfer to the ultimate substrate.

U.S. Pat. No. 3,860,388 describes a method of dye absorption into the surfaces of plastics by placing a polyethylene film between a dye transfer paper and a sheet of plastic and applying pressure and heat thereto. The dyes sublime through the polyethylene film to the plastic film to be dyed.

U.S. Pat. No. 3,915,628 relates to a continuous dry transfer-printing process for textile webs wherein a continuous inert carrier, advantageously stainless steel, aluminum or paper, is applied to the surface of the web, which is then contacted with the material to which the dye is to be transferred followed by heating and sublimation of the dye.

SUMMARY OF THE INVENTION

It has now been found that a process for printing dyes onto disperse dyeable materials such as textiles and films, hereinafter referred to as textile material, by forming an image of a dye in a binder on a polymeric film through which the dye will sublime on heating followed by transfer of the dye to the final substrate can be used to virtually eliminate the problem of inadequate registration in multi-color printing of substrates such as textile materials. The process is a dry process and eliminates the need to clean up the printing equipment or exhausted dye baths.

More specifically, the process of the invention for printing dyes onto a substrate comprises the steps of: forming an image of a dye component which is substantially sublimable at from 160° C. to 215° C., and a resin which binds the dye component on a film of a thermally stable resin which is permeable to said dye component; laminating another film of a thermally stable resin which is permeable to said dye component to the side of the first film to which the dye image was applied to form a sandwich; bringing the sandwich into contact with the textile material to be dyed while the sandwich and fabric are rotated upon a heated drum, to thereby transfer said dye component from the sandwich through the covering layer to the textile material.

DETAILED DESCRIPTION OF THE DRAWINGS

Figure 1:
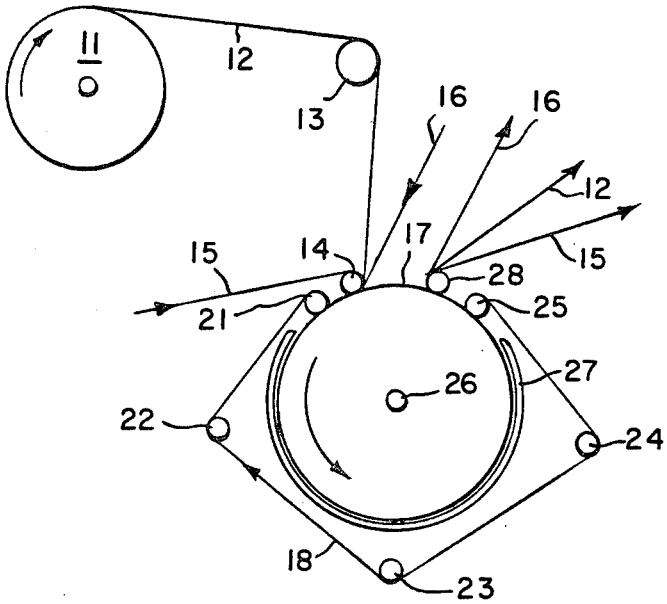
FIG. 1 is a schematic view of the apparatus used to transfer the dye from the polymeric films to two textile materials.

Referring now to FIG. 1 a roll 11 of laminate 12 containing an image of a plurality of sublimable dyes sandwiched between two thermally stable, sublimable-dye-permeable polymeric films is fed around idle roll 13 and on to roll 14, where it is fed along with textile material 15 and textile material 16 around drum 17. The sandwich of textile materials 15 and 16 and laminate 12 is urged against drum 17 by endless belt 18 which travels around rollers 21, 22, 23, 24 and 25. Drum 17 is fitted with means to circulate hot oil 26 and external heater 27 the heat from which causes the dye in laminate 12 to sublime through the two polymeric films within which the dye is sandwiched and dye textile materials 15 and 16. After sublimation of the dyes laminate 12 and fabrics 15 and 16 are passed around roller 28 and taken up by means not shown.

Laminate 12 can be formed by any of a number of printing processes such as magnetic printing, electrostatic transer printing, gravure printing, offset printing, rotary screen printing etc. The preferred printing technique is magnetic printing on an endless belt followed by offset transfer of the printed image to a film and then lamination of the film to another film to form a sandwich with the dye image in the middle of the sandwich.

Figure 2:
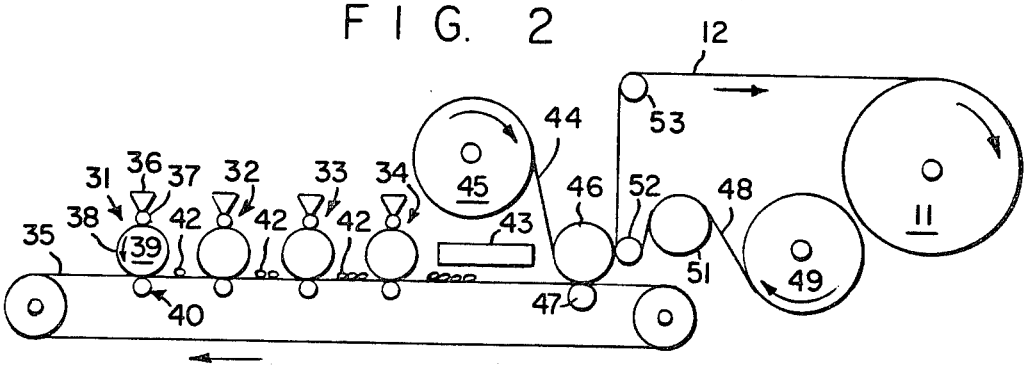
FIG. 2 is a schematic view of a preferred apparatus for forming an image of dye between two polymeric films.

Referring now to FIG. 2, a plurality of printing stations 31, 32, 33 and 34 are serially disposed along endless belt 35. Each of printing stations comprises a feed hopper 36, a decorator 37, a magnetic imaging member 38 mounted on the surface of a drum 39 and a DC corona or electrically charged roller 40. If desired additional appurtenances such as AC coronas, vacuum knifes and magnetic write heads may be stationed around magnetic imaging member 38 such as disclosed in U.S. Pat. No. 4,117,498 the disclosure of which is hereby incorporated by reference. The endless belt preferably is formed from a dielectric material which is not receptive to dyes and to which toner does not adhere on heating. In the present case there are four printing stations which print magenta, cyan, yellow and black. There may be a larger or smaller number of printing stations used depending on the design being printed. After toner 42 has been deposited by each of the printing stations 31, 32, 33 and 34 it is passed under infrared heater 43 where the toner is heated. A polymeric film 44 is unwound from roll 45 and fed along with decorated endless belt 35 between oil heated offset roll 46 and nip roll 47 to transfer the toner image from endless belt 35 to polymeric film 44. A polymeric film 48 is removed from roll 49, fed around oil heated roll 51 and between nip roll 52 and oil heated offset roll 46 to form laminate 12. Laminate 12 is fed around idle roll 52 and taken up on roll 11.

DETAILED DESCRIPTION OF THE INVENTION

The present invention finds use in dyeing textile materials formed of polymers that are "disperse dyeable", that is, material capable of forming a solid solution of the dye in the textile material. Such textile materials include polyesters and polyamides, with polyesters such as poly(ethylene terephthalate) being particularly preferred.

The present invention involves bringing a film bearing an image of a sublimable disperse dye into contact with the textile material which is to be dyed to form a sandwich of the image bearing film and the textile material. The sandwich is then heated to cause the dye to sublime and disperse through the film and dye the surface of the textile material. By repeating the transfer process several textile materials can be dyed from a single dye-image bearing film.

The dyes used to form the dye image should be sublimable at a temperature of from about 160° C. to 215° C. Dyes falling into this category include low-energy and medium-energy dyes, with medium-energy dyes being preferred. Examples of such dyes include

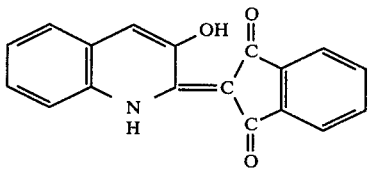

a medium energy yellow disperse dye,

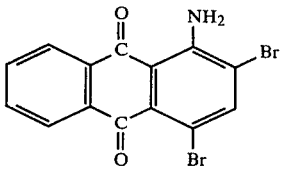

a low to medium energy red disperse dye,

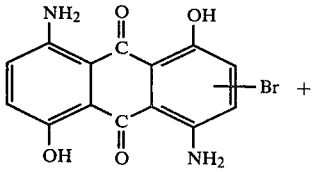

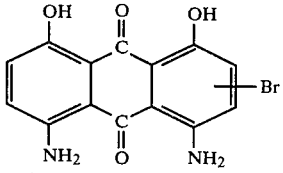

a medium energy blue disperse dye, and

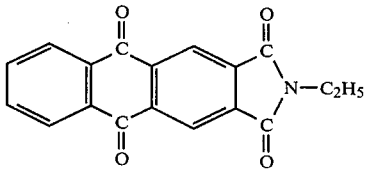

a greenish blue disperse dye.

The dye image can be applied to the film by any of a number of techniques. The preferred technique for applying the dye image to the film is magnetic printing such as described in U.S. Pat. Nos. 4,009,186 and 4,117,498, the disclosures of which are hereby incorporated by reference.

The film must be thermally stable at the transfer temperature used and permeable to the sublimable dye. Suitable thermally stable sublimable-dye-permeable films include polyesters such as poly(ethylene terephthalate). If desired an additional film can be laminated to the film to form a sandwich of the dye image between the two films and the dye image transferred to two textile materials. Alternatively the film bearing the dye image can be laminated to a non-dye permeable film such as aluminized poly(ethylene terephthalate) and the dye image.

When forming the dye image by magnetic printing a structured latent magnetic image is formed in a pre-structured ferromagnetic material on an electrically conductive support.

The formation of a latent magnetic image in a ferromagnetic material imposed on an electrically conductive support can be accomplished by techniques known in the art of magnetic recording. Examples of such techniques are described in U.S. Pat. Nos. 4,009,186 and 4,117,498.

The magnetic image is developed by applying a ferromagnetic toner comprising a ferromagnetic component, a dye component which is substantially sublimable at from 160° C. to 215° C., and a resin, which substantially encapsulates the ferromagnetic component and the dye component.

The ferromagnetic component of the ferromagnetic toner can consist of hard magnetic particles, soft magnetic particles, or a binary mixture of hard and soft magnetic particles. Such particles are described in U.S. Pat. Nos. 4,099,186 and 4,117,498.

The relative amounts of resinous material and ferromagnetic component in the toner are determined by the desired adhesive and magnetic properties of the toner particle. Generally, a ratio of resinous material to ferromagnetic material of 0.11:1 to 3.3:1 is useful, with the range of 0.40:1 to 1.0:1 being preferred.

Other components may optionally be added to the ferromagnetic toner, such as those described in U.S. Pat. Nos. 4,099,186 and 4,117,498.

Normally the developed image is formed on a continuous belt comprising a thermally stable, dielectric, non-dye-receptive material. Examples of such materials include a poly(tetrafluoroethylene) on a fiberglass belt material or on a belt of aramid fibers, e.g., Kevlar®. Other useful thermally stable, dielectric, non-dye-receptive materials for use in continuous belts according to the invention include, e.g., commercially available Teflon® or silicone coated belts.

The developed image on the continuous belt is transferred by heat and pressure to a film of a thermally stable resin which is permeable to the dye component of the ferromagnetic toner. Examples of resin which can be used to form the covering layer according to the invention include polyester film, e.g., Mylar®, polyamide film (Dartek), polyvinyl chloride films, etc.

The concentration of the dye component in the ferromagnetic toner can vary over a range of from about 1.0% to about 10.0% by weight, based on the total weight of the toner. In a preferred embodiment, the concentration of dye component is about 3.0% and 9.0% by weight, for single and multiple passes respectively.

The resin which encapsulates the ferromagnetic component and the dye component of the ferromagnetic toner may be any known, readily fusable, natural, modifed natural, or synthetic resin or polymer. Examples of such resins are described in U.S. Pat. Nos. 4,099,186 and 4,117,498, as well as the specific encapsulation technique therefore.

DESCRIPTION OF THE PREFERRED EMBODIMENTS

EXAMPLE 1

A yellow toner mix is prepared by mixing 5.0 wt % of

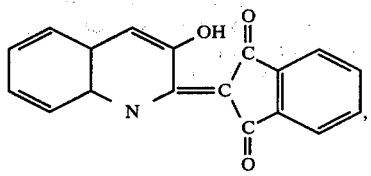

40.0 wt % Carboset XL 11, a terpolymer of methyl methacrylate, ethyl acrylate, and acrylic acid having a glass transition temperature of 55° C. and an acid No. of 74 mg KOH/g, 1.5 wt % Reax 85, a lignosulfonate dispersing agent diluent and 53.5 wt % of Magnetic Oxide No. 7029 $Fe_3O_4$ type ferroferric oxide.

A red toner mix is prepared by mixing 7.0 wt % of

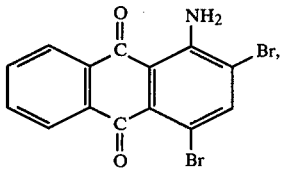

37.61 wt % carboset XL 11, 1.89 wt % Reax 85 A and 53.50 wt % Magnetic Oxide No. 7029.

A blue toner mix is prepared by mixing 7.0 wt %

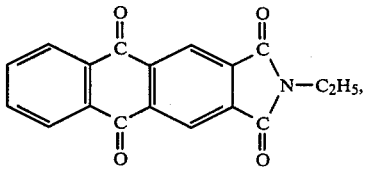

38.1 wt % Carboset, 1.4 wt % Reax 85 A and 53.5 wt % Magnetic Oxide No. 7029.

A black toner mix is prepared by mixing 3.00 wt % of the above yellow dye, 4.50 wt % of the above red dye, 4.00 wt % of the above blue dye, 36.95 wt % of Carboset XL 11, 1.55 wt % Reax 85 A, and 50.00 wt % Magnetic Oxide No. 7029.

The toner mixes are converted into toner by spray drying an aqueous dispersion of the components set forth above.

Each of the magnetic imaging members are formed before structure development of a 350μ inches (8.9μ meters) thick layer of acicular chromium dioxide in a binder on an electrically grounded silver coated rubber roll which is 12 inches (0.3 meter) wide. The magnetic imaging member is magnetically structured to 460 pole reversals/inch (18 pole reversals/mm) or 230 cycles 1 inch (9 cycles/mm) or 55 microns/pole reversal by recording a square wave with a magnetic write head at 35 m Amps and 6 to 8 Volts. A film positive of the individual colors to be printed is placed in contact with the magnetically structured roll and stepwise uniformly illuminated by a Xenon flash at 3.3 KV with a 15° turn per flash, passing through the film positive. The dark areas of the film positive, corresponding to the areas to be printed, absorb the energy of the Xenon flash; whereas the clear areas transmit the light and heat the acicular chromium dioxide beyond a Curie point of about 116° C. thereby demagnetizing the exposed magnetized lines of acicular chromium dioxide. The thusly magnetized rolls are then registered with each other in the apparatus depicted in FIG. 2.

The four toners are individually fed from a slot in the hoppers to decorate the latent magnetic images in each of the magnetic imaging members by a decorator. The decorator comprises a rotating magnetic cylinder inside a non-magnetic sleeve. As the magnetic imaging member rotates after being decorated with toner it first passes an AC corona which serves to neutralize any electrostatic charges which may be adhering toner to the magnetic imaging member. Then a vacuum knife removes stray toner from the non-image areas. The toner is then negatively charged with a DC corona. The toner is then transferred to a polytetrafluoroethylene coated woven aramid fiber belt. A negatively charged voltage biasing roll on the backside of the belt is used to effect transfer of the toner from the magnetic imaging member to the belt. After toner transfer the imaging member passes in this order, an AC corona, a brush and a vacuum knife to remove any remaining toner, prior to returning to the decorator. This is repeated at each of the remaining printing stations. The toner particles are then coalesced together with a battery of infrared lamps which heat the toner to about 90° C. The belt with the toner image is then fed, along with a 0.5 mil (0.013 m) thick poly (ethylene terephthalate) film, between an offset roll maintained at 110° C. and an unheated nip roll on the backside of the belt to transfer the toner from the belt to the film. The thusly decorated film continues to travel around the heated offset roll for about 90° to a point where it is fed together with another 0.5 mil (0.013 mm) thick poly(ethylene terephthalate) film between the heated offset roll and a nip roll to laminate the two films together, after which the laminate is taken up on a roll.

The laminate is fed, together with a textile fabric on either side, around a drum fitted with internal hot oil heat and external infrared heaters and an endless pressure belt of Teflon ®. The surface of the drum is maintained at 210° C. The first pass around the drum utilizes a residence time of 30 seconds. After passing around the drum the two textile fabrics and the laminate are separately taken up on rolls. The process is repeated using the laminate a second time using a residence time on the drum of 45 seconds and a third time with a residence time on the drum of 60 seconds. The six textile fabrics are all dyed to nearly the same degree and depth of shade. The fabric used is a woven 24 gauge 100% poly(ethylene terephthalate) weighing 5.7 oz/yd$^2$ (0.19 Kg/M$^2$).

I claim:

1. A process for printing a disperse dyeable textile material with a dye comprising the steps of:

forming an image comprising a dye component which is substantially sublimable at from 160° C. to 215° C. on a film of a thermally stable resin which is permeable to said dye component by the application of heat and pressure;

covering the side of the film bearing the image with a web of paper or a resinous material to form a laminate, then bringing the laminate into contact with a disperse dyeable textile material to be dyed while the laminate and disperse dyeable textile material are rotated upon a heated drum, with the disperse dyeable textile material facing the side of the film in the laminate which does not bear the image, to thereby transfer said dye component through the film to the disperse dyeable material; and separating the disperse dyeable textile material from the laminate.

2. The process of claim 1 wherein the film is poly(ethylene terephthalate).

3. The process of claim 2 wherein the dye is a disperse dye.

4. The process of claim 3 wherein the film on the side bearing the image is laminated to a second film of a thermally stable resin which is permeable to said dye component.

5. The process of claim 4 wherein a textile material is brought into contact with both sides of the films and dye transferred to both textile materials.

6. The process of claim 1 wherein the dye is transferred to disperse dyeable textile materials from both sides of the laminate thereof a plurality of times.

7. The process of claim 6 wherein the disperse dyeable textile materials are polyester fabrics.

8. The process of claim 7 wherein at least one film is made of a polyester resin.

9. A process as in claim 8 wherein the film of polyester resin is between about 0.0064 mm (0.25 mil) and 0.0254 mm (1.0 mil) thick.

* * * * *